US009972948B2

(12) United States Patent
Wagner et al.

(10) Patent No.: US 9,972,948 B2
(45) Date of Patent: May 15, 2018

(54) PLUG OR SOCKET AS A COMPONENT FOR AN ELECTRICAL CONNECTOR AND ELECTRICAL CONNECTOR

(71) Applicant: ODU GmbH & Co. KG, Mühldorf (DE)

(72) Inventors: Cornelia Wagner, Mühldorf (DE); Markus Seidl, Kastl (DE); Stefan Franzl, Töging (DE)

(73) Assignee: ODU GmbH & Co. KG, Mühldorf (DE)

( * ) Notice: Subject to any disclaimer, the term of this patent is extended or adjusted under 35 U.S.C. 154(b) by 0 days. days.

(21) Appl. No.: 15/171,736

(22) Filed: Jun. 2, 2016

(65) Prior Publication Data

US 2016/0359280 A1 Dec. 8, 2016

(30) Foreign Application Priority Data

Jun. 5, 2015 (EP) ..... 15001676

(51) Int. Cl.
*H01R 13/648* (2006.01)
*H01R 13/719* (2011.01)
(Continued)

(52) U.S. Cl.
CPC ..... *H01R 13/719* (2013.01); *H01R 13/2421* (2013.01); *H01R 13/6471* (2013.01); *H01R 24/50* (2013.01); *H01R 2103/00* (2013.01)

(58) Field of Classification Search
CPC .. H01R 4/64; H01R 13/65802; H01R 23/688; H01R 23/7073
(Continued)

(56) References Cited

U.S. PATENT DOCUMENTS 4,611,867 A 9/1986 Ichimura et al.
5,161,987 A * 11/1992 Sinisi ..... H01R 23/688 439/101
(Continued)

FOREIGN PATENT DOCUMENTS

EP 0446980 A1 9/1991
EP 0844699 A2 5/1998
(Continued)

OTHER PUBLICATIONS

European Patent Office—Extended European Search Resport for European Application No. 15001676.4 dated Nov. 5, 2015 (8 pages).

*Primary Examiner* — Thanh Tam Le
(74) *Attorney, Agent, or Firm* — Harris Beach PLLC

(57) ABSTRACT

A component for an electrical connector, said component bearing a field of electrically conducting signal elements (12) electrically insulated from each other and a field of electrically conducting shield elements (10), the shield elements being electrically interconnected with each other. For each of the signal elements (12), in any partial circumference extending over an angle (α) of more than 160 degrees from this signal element at least one of the shield element (10) is arranged that is closer to this signal element (12) than the any other signal element (12) of the field of signal elements (12). Each of these shield elements extends across an angle (β) of less than 160 degrees from the signal element (12). The number of shield elements (10) is the number of the signal elements (12) times 3 or less.

10 Claims, 4 Drawing Sheets

Figure 1:
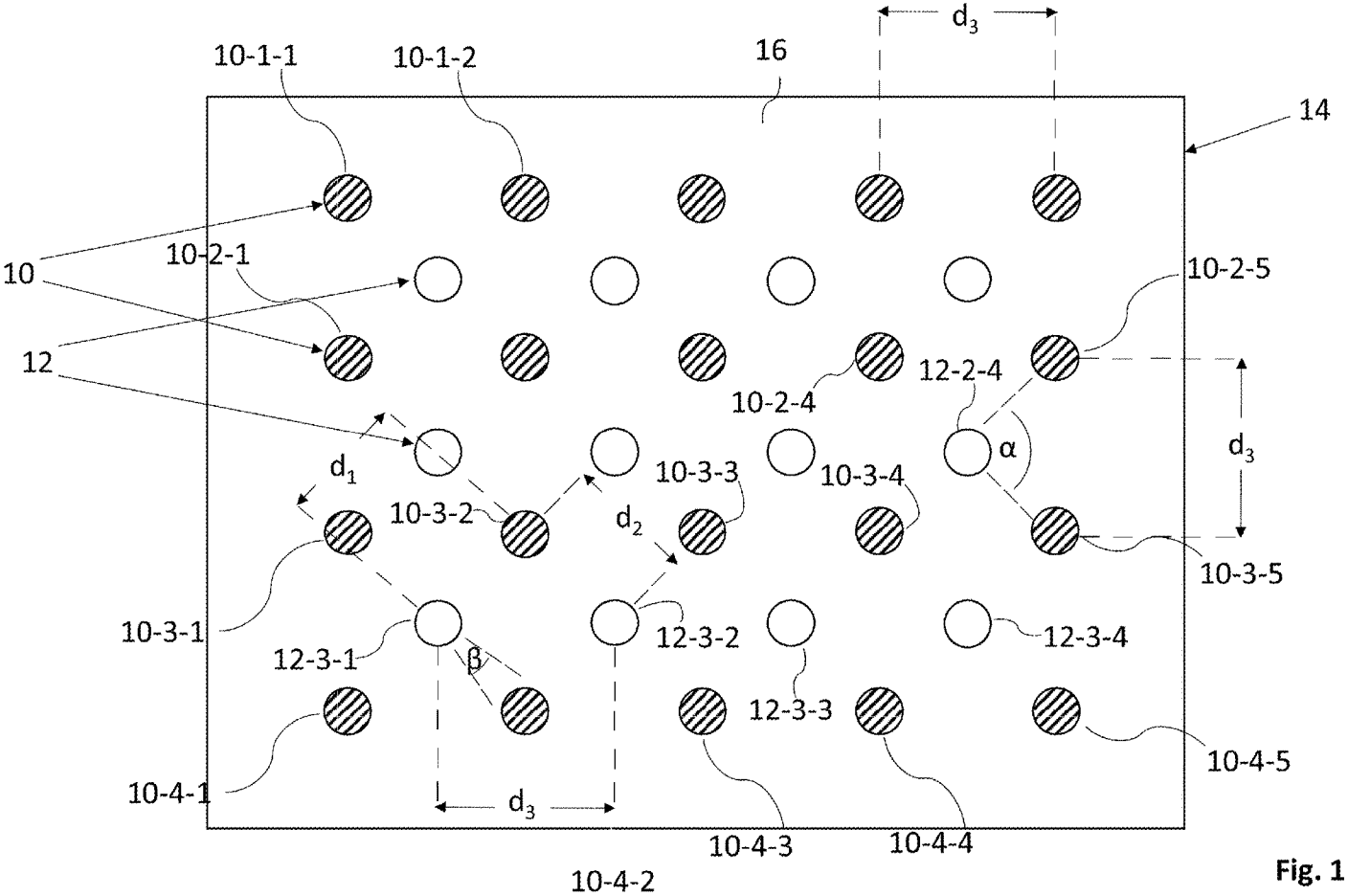

(51) Int. Cl.
*H01R 13/6471* (2011.01)
*H01R 24/50* (2011.01)
*H01R 13/24* (2006.01)
*H01R 103/00* (2006.01)

(58) Field of Classification Search
USPC ..... 439/92, 95, 101, 108, 607.08, 607.09, 439/607.1, 660
See application file for complete search history.

(56) References Cited

U.S. PATENT DOCUMENTS 5,167,531 A * 12/1992 Broschard, III ... H01R 23/6873 439/541.5
5,174,770 A * 12/1992 Sasaki ..... H01R 12/727 439/108
5,342,211 A * 8/1994 Broeksteeg ..... H01R 13/6587 439/108
5,395,257 A * 3/1995 Lein ..... H01R 23/688 361/772
5,525,067 A * 6/1996 Gatti ..... H01R 23/6873 439/108
5,639,263 A * 6/1997 Zell ..... H01R 23/688 439/108
6,109,933 A 8/2000 Lenoir et al.
6,120,306 A * 9/2000 Evans ..... H01R 23/688 439/101
6,146,157 A * 11/2000 Lenoir ..... H01R 23/688 439/101
6,695,627 B2 * 2/2004 Ortega ..... H01R 13/04 439/108
8,740,651 B2 * 6/2014 Lee ..... H01R 12/58 439/108
9,071,025 B2 * 6/2015 Uozumi ..... H01R 13/659

FOREIGN PATENT DOCUMENTS

EP 0891017 A1 1/1999
EP 1672742 A1 6/2006
JP 60-068570 A 4/1985
JP H06349554 A 12/1994
JP 2000-323871 A 11/2000

* cited by examiner

Fig. 2a
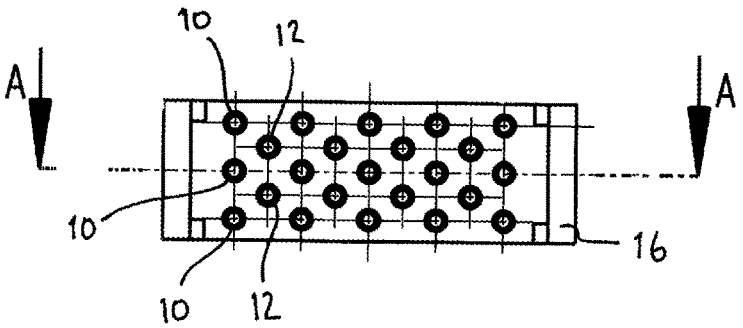
Fig. 2b
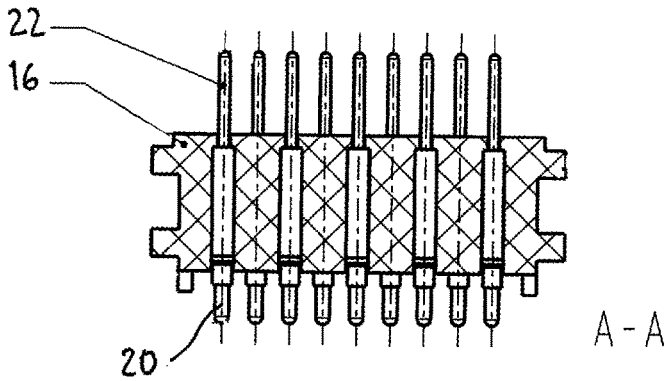
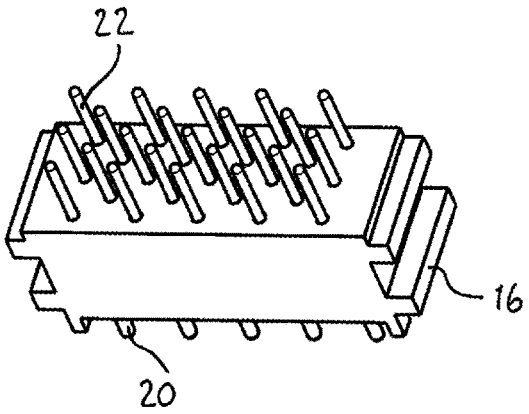
Fig. 2c

Fig. 3a
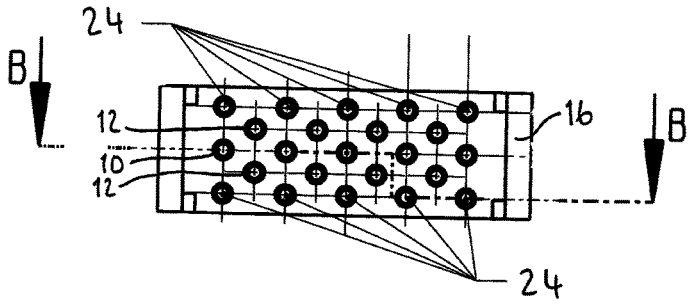
Fig. 3b
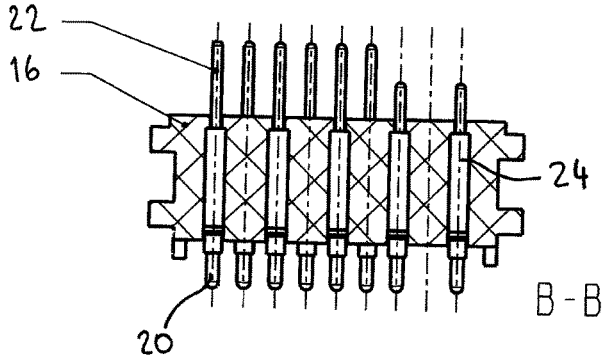
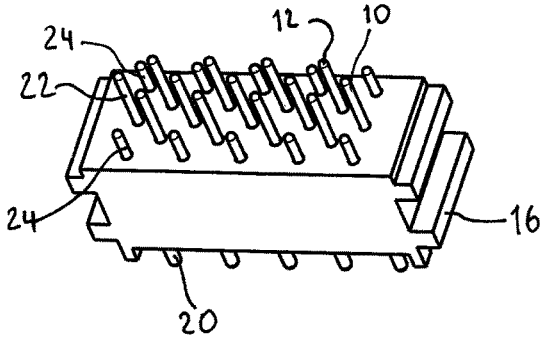
Fig. 3c

Fig. 4a
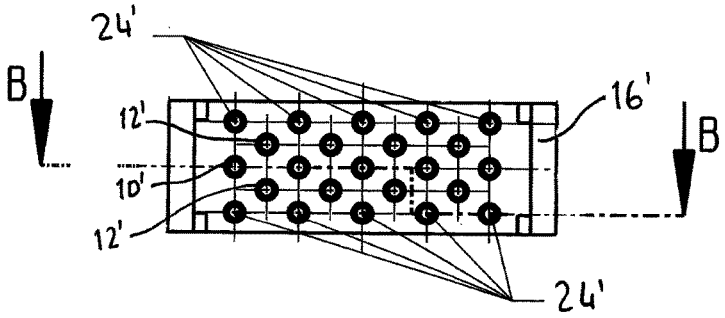
Fig. 4b
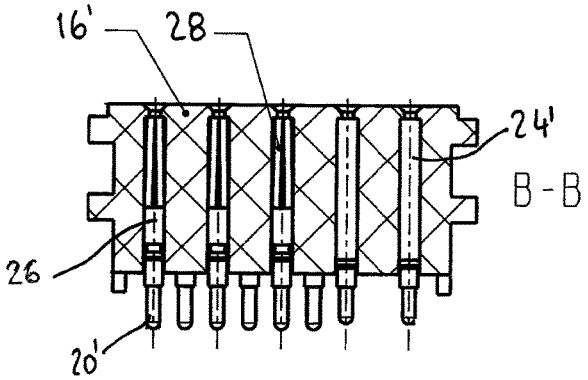
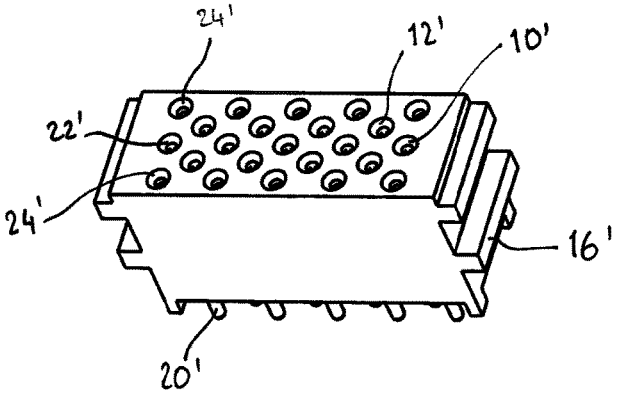
Fig. 4c

PLUG OR SOCKET AS A COMPONENT FOR AN ELECTRICAL CONNECTOR AND ELECTRICAL CONNECTOR

FIELD OF THE INVENTION

The invention relates to a component for an electrical connector, such as a plug or a socket. The invention also relates to an electrical connector.

BACKGROUND OF THE INVENTION

In many applications for the transmission of electrical signals shielded cables are employed to in order to avoid interference between the signal transmitted by a particular cable with external signals such as signal transmitted by other cables. In particular, for the transmission of high frequency signals coaxial cables are a common type of shielded cables. A coaxial cable conducts the electrical signal using an inner conductor enclosed by a cylindrical sheath for shielding the conductor. Normally, the shield is kept at ground potential. In such coaxial design, the electric and magnetic fields can essentially be confined to the space between the inner conductor and the shield with little leakage outside the shield. Conversely, electric and magnetic fields outside the cable are largely kept from causing interference to signals inside the cable.

In order to connect coaxial cables in a way that leakage and interference is also avoided at the point of connection, coaxial connectors are frequently used. Typical coaxial connectors comprise a hollow cylinder of a plug of the connector, which when connected overlaps with a hollow cylinder of the socket of the connector to shield an inner conductor of the connector. It can be a drawback of such coaxial connectors that they are expensive to make, difficult to connect and less suited for a high number of mating cycles. The latter can be of particular disadvantage if an apparatus comprises interchange parts, which are frequently exchanged and which are attached to the apparatus by means of a coaxial connector. For example, many medical imaging apparatus comprise a selection of interchangeable imaging heads that are connected to a display unit or an application part via a coaxial cable and a coaxial connector. Such coaxial connector can be prone to fail due to frequent replacement of the imaging head. Moreover, it can be a drawback of conventional coaxial connectors that they require a considerable amount of space, which may, for example, entail high manufacturing costs, complicate handling and hamper miniaturisation.

In the prior art, it has been contemplated to replace the shield of a coaxial connector with a plurality of pins and sleeves. For instance, DE 101 64 799 B4 discloses an electrical connector for use with a cellular telephone wherein, in the plug, nine spring-loaded pins are arranged in three rows with three pins each. In each case, the central pin transmits a signal and the eight surrounding pins act as shields. Similarly, DE 199 45 176 B4 discloses an arrangement of spring-loaded contacts in which the signal transmitting contact in the centre is surrounded by four grounded contacts.

From KR 100275512 B1 an electrical connector is known which, in a first section, has alternating signal pins and ground pins. In a second section, for the transmission of a differential electrical signal groups of four signal pins in arranged in squares are separated by rows of ground pins so that each group of signal pins is surrounded by 8 or 12 ground pins. At the lateral sides of the connector, there are ground plates provided for shielding. KR 100275512 B1 suggests using the arrangement for connecting a motherboard to a daughterboard in an ATM switch via a backplane connection. A backplane connection in general does not need to withstand many mating cycles. Rather, it is connected upon assembly of the apparatus in which it is employed, and it typically is disconnected only if a faulty part of the apparatus needs replacement. Moreover, a backplane connection usually is not exposed to the outside of the apparatus but hidden inside the apparatus together with the apparatus' other internal components such as active electrical and electronic components. Moreover, a backplane connection is not a cable-cable connection and backplane connectors in general are unsuitable for cable-cable connections.

OBJECT OF THE INVENTION

It is an object of the present invention to provide an improved component such as a plug or a socket for an electrical connector. The invention also aims at providing an improved electrical connector. In particular, the invention seeks to provide a plug, a socket or a connector that overcomes disadvantages of the prior art plugs, sockets and connectors.

SUMMARY OF THE INVENTION

The problem is solved by a component for an electrical connector according to claim 1. The component bears a field of signal elements which are electrically conducting and a field of shield elements which are also electrically conducting. In the context of the present invention, a field of elements is plurality of elements. The elements are typically arranged in a common surface, usually but not necessarily a flat surface, also referred to as the mating plane.

By electrically insulating the signal elements from each other, it can be achieved that each signal element serves to transmit a different signal. In particular, with the signal elements signals can be transmitted to or from the component to corresponding elements of a counter-component of the electrical connector of the component and the counter-component are mated. For this purpose the signal elements can mate with corresponding elements of the counter-component. The counter-component will preferably be distinct from the component, but the invention also encompasses embodiments in which the counter-component is considered part of the component or in which the component is at the same time the counter-component. The preferred signal elements are electrical contacts that can each electrically contact a corresponding element of the counter-component. Yet, the invention also encompasses embodiments in which in the case of one or more of the signal elements a signal is transmitted without direct electrical contact between these signal element(s) and corresponding element(s) of the counter-component; such embodiments may, for example, exploit that signals at certain high frequencies can be transmitted via narrow air gaps or other electrically non-conducting gaps.

The shield elements can shield the signal transmitted by the signal elements. The fact that—unlike in a coaxial connector—for each signal element the shield elements shielding this signal element extend only across an angle of less than 160 degrees from the signal element is compensated by the fact that in any partial circumference extending over an angle of more than 160 degrees from this signal element at least one such shield element is arranged that is closer to this signal element than any other signal element.

In other words, for each signal element a single conventional coaxial shield is replaced by plurality of shield elements distributed around the signal element, and each of these shield elements is closer to the signal element than the any other signal element. To ensure that these shielding element are—to the extend necessary for efficient shielding—at a common electrical potential, they are electrically interconnected. Replacing a single coaxial shield element with a plurality of shield elements can simplify the construction and reduce the manufacturing costs of the connector element and the connector as a whole. It also allows for the construction of connectors that are easier to mate and can withstand a higher number of mating cycles.

Electrical interconnection between the shield elements will preferably be direct but can also be indirect. Electrical conduits (e.g. cables or a circuit board's traces) directly connecting the corresponding shield elements with each other would constitute direct interconnection. If, in contrast, the shield elements are interconnected via one or more other parts of the component, this would constitute an indirect interconnection. For example some or all of the shield elements may be interconnected via a housing of the component or they may be interconnected via corresponding elements of the counter-component which, in turn, may also be interconnected directly or indirectly.

Preferably, but not necessarily, one or more shield elements can electrically connect with corresponding elements of the counter-component. In some embodiments, shield elements can electrically connect with corresponding elements of the counter-component. Connecting a shield element with a corresponding element of the counter component can contribute to ground the shield element (and in some embodiments other shield elements directly or indirectly connected with this shield element). Preferably, for more than one signal element, more preferably all signal elements, at least one of the shield elements that are arranged closer to the respective signal element than any other signal element of the field of signal elements electrically connects with corresponding elements of the counter-component.

The invention is inter alia based on the finding that a considerable number of shield elements can be shared between signal elements even if these signal elements carry different signals. In particular, it has been found that effective shielding can still be achieved even if the number of shield elements is the number of the signal elements times 3 or less. Due to such extensive sharing of shields by electrical contacts, the overall number of electrically conducting elements can be reduced. As a result, smaller connectors can be built. Moreover, with the invention it is achievable to simplify the construction and to reduce the manufacturing costs of the connector element and the connector as a whole.

Preferred Embodiments of the Invention

The preferred signal elements have a certain extension in a mating direction of the component, and an extension of the shield elements in this direction is at least 25%, more preferably at least 50%, more preferably at least 75%, more preferably at least 100% of the extensions of all of their corresponding signal elements in the mating direction of the component of the electrical connector that carries the respective signal element. Thereby it can be achieved that each signal element is well shielded by the shielding elements. The shield elements that correspond to a signal element are all shield elements that are closer to the signal element than the closest other signal element is to this signal element.

Some or all of the signal elements or their corresponding elements can be pins, preferably cylindrical pins as they are commonly used in electrical connectors. Some or all of the signal elements or their corresponding elements or the shield elements or their corresponding elements may be spring-loaded pins, for example the spring-loaded pins disclosed in DE 199 45 176 84. Some or all of the signal elements or their corresponding elements or the shield elements or their corresponding elements can be flat contact pads, for example of the type that interacts with the spring-loaded pins in DE 199 45 176 B4. Some or all of the signal elements or their corresponding elements or the shield elements or their corresponding elements can be contacts stamped from sheet metal, for example of the type offered by ODU GmbH & Co KG under the brand names STAMPTAC®. Some or all of the signal elements or their corresponding elements or the shield elements or their corresponding elements can be contact sleeves, preferably hollow cylindrical contact sleeves. The contact sleeves may employ as contact elements one or more wire springs such as the ones disclosed in DE 42 27 007 A1 or offered by ODU GmbH & Co KG under the brand names SPRINGTAC®, wire springs which can resiliently contact corresponding contact elements such as pins to establish an electrical contact. The contact sleeves may employ as a contact element a lamella basket as for example disclosed in DE 87 16 204 U or EP 2209167 B1 or offered by ODU GmbH & Co KG under the brand names LAMTAC®; In a contact sleeve with a lamella basked, one or more lamellae of the lamella basket can resiliently contact corresponding contact elements such as pins to establish an electrical contact. The contact sleeves may be slotted sleeves as offered by ODU GmbH & Co KG under the brand names TURNTAC®, such that the parts of the sleeves between the slots can resiliently contact corresponding contact elements such as pins to establish an electrical contact. Some or all of the pins or sleeves typically extend in parallel to each other.

The preferred component is a plug or a socket for an electrical connector. In the context of the present invention, a plug is a component of an electrical connector that is mated with a socket of the electrical connector to transmit one or more signals. Yet, the component of the present invention may also comprise both a plug and a socket of the electrical connector, that is, the component can be its own counter-component: In one embodiment, the signal elements are located on the plug while the shield elements are located on the socket, or vice versa. In another embodiment, one or more of the signal elements can be located on a plug while the remaining signal element(s) is or are located on the socket. Alternatively or in addition one or more of the shield elements of the field of shield elements can be located on a plug while the remaining shield element(s) is/are on the socket. Preferably, each shield element will either be part of the plug or part of the socket of the electrical connector. Yet, the invention also encompasses embodiments in which one part of a shield element is located on the plug and another on the socket of the electrical connector. For example, the two parts may only combined have an extension that is at least 25%, more preferably at least 50%, more preferably at least 75%, more preferably at least 100% of the extensions of all of their corresponding signal elements in the mating direction of the component of the electrical connector that carries the respective signal element.

Preferably the component's number of shield elements is less than three time the number of the signal elements. More preferably, number of shield elements is the number of the signal elements times 2.5 or less, more preferably times 2 or less. In a particularly preferred embodiment of the invention, the component's number of shield elements is less than twice time the number of the signal elements. Yet, preferably, the number of shield elements is greater than the number of signal elements. This can contribute to a good shielding of the signal elements.

A preferred component comprises rows, preferably linear rows, of shield elements only, alternating with at least one row, preferably a linear row or linear rows, of signal elements only. Preferably, the number of rows of shield elements exceeds the number of rows of signal elements by one. For instance, there may be 4 rows of shield elements, separated by 3 rows of signal elements. Preferably, the number of shield elements in a row of shield elements exceeds the number of signal elements in each adjacent row of signal elements by 1. Preferably, all rows of signal elements have the same number of elements. Likewise, preferably all rows of shield elements have the same number of elements. For example, the rows of shield elements may comprise 5 shield elements each while the rows of signal element comprise 4 elements each.

Preferably, for each signal element there are at least 3—more preferably at least 4—shield element closer to this signal element than the any other of the signal elements of the field of signal elements. With a large number of shield elements per signal elements, a particularly good shielding can be achieved.

In a preferred embodiment of the invention, for each of the signal elements, in any partial circumference extending over an angle of more than 120 degrees—more preferably 100 degrees, more preferably 90 degrees—from this signal element at least one of the shield element is arranged that is closer to this signal element than the any other signal element of the field of signal elements. The preferred shielding elements are distributed equidistantly around their corresponding signal element. Advantageously, by distributing the shielding elements well distanced from each other, shielding can be improved.

Preferably, for each of the signal elements, each shield element that is closer to this signal element than the any other signal element of the field of signal elements extends across an angle of less than 100—more preferably 60 degrees, more preferably 30 degrees, more preferably 20 degrees—from the signal element. This can simplify the construction and reduce the manufacturing costs of the connector element and the connector as a whole. It also allows for the construction of connectors that are easier to mate and can withstand a higher number of mating cycles.

In addition to the above, the component can comprise further electrically conduction elements. Preferably, the amount conducting elements of the component that are part of the field of electrically conducting signal elements (12) or the field of electrically conducting shield elements (12) according to the invention are at least 50%, more preferably more than 75%, still more preferably more than 90%, most preferably all of all conducting elements. Such components can particularly well take advantage of the advantages of the present invention. In addition, the component may comprise other, elements such as fluid conducting elements.

In a preferred embodiment of the invention at least one of the signal elements and its corresponding shield elements—preferably all of the signal elements and their corresponding shield elements—are designed and arranged in such a manner that their wave impedance is greater than 25Ω, more preferably greater than 35Ω. Preferably, at least one of the signal elements and its corresponding shield elements—preferably all of the signal elements and their corresponding shield elements—are designed and arranged in such a manner that their wave impedance is smaller than 150Ω, more preferably smaller than 130Ω. In an embodiment of the invention, at least one of the signal elements and its corresponding shield elements—preferably all of the signal elements and their corresponding shield elements—are designed and arranged in such a manner that their wave impedance is between 37Ω and 63Ω, preferably between 45Ω and 55Ω. In an embodiment of the invention, at least one of the signal elements and its corresponding shield elements—preferably all of the signal elements and their corresponding shield elements—are designed and arranged in such a manner that their wave impedance is between 56Ω and 94Ω, preferably between 67Ω and 83Ω. In one embodiment of the invention, at least one of the signal elements and its corresponding shield elements—preferably all of the signal elements and their corresponding shield elements—are designed and arranged in such a manner that their wave impedance is between 75Ω and 125Ω, preferably between 90Ω and 110Ω.

Preferably, the distance between a signal element and a corresponding shield element is greater than 0.5 mm, more preferably greater than 1 mm. Preferably, the distance between a signal element and a corresponding shield element is smaller than 5 mm, more preferably smaller than 3 mm. Preferably, the distance between adjacent shield elements is greater than 1 mm, more preferably greater than 2 mm. The preferred distance between adjacent shield elements is less than 8 mm, more preferably less than 4 mm. Likewise, the distance between adjacent signal elements preferably is greater than 1 mm, more preferably greater than 2 mm. Preferably, the distance between adjacent signal elements is less than 8 mm, more preferably less than 4 mm.

In a preferred component according to the invention, the signal elements and/or the shield elements are cylindrical pins, for example solid or hollow cylinders.

The preferred application of the component is in an arrangement for transmitting electrical signals at a frequency of above 10 MHz, more preferably even above 50 MHz, more preferably even above 100 MHz. Signals at such frequencies con profit particularly well from the shielding according to the invention. The preferred application of the component is in an arrangement for transmitting electrical signals at a frequency of below 1500 MHz, more preferably even below 1000 MHz, more preferably even below 500 MHz. The shielding according to the present invention can be particularly effective at signal below this frequency.

The object is also solved by an electrical connector including a plug and a socket, wherein the plug and/or the socket are of the inventive type. In the preferred electrical connector, at least one of plug and socket comprises counter-elements to mate with, preferably contact, signal elements for transferring a of with the force of a spring being applied to ensure good contact.

Moreover, preferably for at least one of the shield elements a counter-element should be provided to mate, preferably contact with. It is an achievable advantage of this embodiment of the invention that by means of contact with a counter element, the shield element can be grounded. Preferably for each signal element at least one ground element is provided with a counter-element to contact with. In such embodiment, the other shield elements can be grounded by means of the electrical interconnection between the shield elements. In the preferred electrical connector, furthermore, the plug and/or the socket comprise housings to which one or more of the shield elements are electrically connected. A socket according to the invention can be provided in a housing contacting the ground such that when a shield element contacts the housing, it is grounded as well. The plug might be part of a device that is not grounded itself, e.g. a handheld device, and the plug's shield elements would then need to be grounded by contacting the grounded shields of the socket. Of course the role of the plug and the socket can also be inversed.

SHORT DESCRIPTION OF THE DRAWING

The present invention will be explained herein-below with respect to a preferred embodiment, making reference to the drawing, in which FIG. 1 depicts a scheme of the overall arrangement of pins in an inventive plug or of sockets in an inventive socket;

FIG. 2*a* depicts a plug in a view onto the signal-transmitting pins' terminals that connect to a printed circuit board in the plug;

FIG. 2*b* depicts a cross-section of the plug of FIG. 2*a* along A-A;

FIG. 2*c* depicts the plug of FIGS. 2*a* and 2*b* in a perspective view;

FIG. 3*a* depicts a plug according to the invention in a view onto the signal-transmitting pins' terminals that connect to a printed circuit board in the plug;

FIG. 3*b* depicts a cross-section of the plug of FIG. 3*a* along B-B;

FIG. 3*c* depicts the plug of FIGS. 3*a* and 3*b* in a perspective view;

FIG. 4*a* depicts a socket according to the invention in a view onto the onto the signal-transmitting contact sleeves' terminals that connect to a printed circuit board in the socket;

FIG. 4*b* depicts a cross-section of the socket of FIG. 4*a* along B-B; and FIG. 4*c* depicts the socket of FIGS. 4*a* and 4*b* in a perspective view.

DETAILED DESCRIPTION OF THE INVENTION IN ITS PREFERRED EMBODIMENTS

In the figures, identical reference numerals indicate parts that are identical or correspond to each other in there various embodiments of the invention. An arrangement of cylindrical contact pins of a plug according to the invention is depicted in FIG. 1. The contacts are viewed perpendicularly to their extension, i.e. the tips of the pins are shown in FIG. 1. The same arrangement applies for sleeves in a socket according to the invention as well. A reference to a pin in the following can be equally applied to a sleeve in a socket.

The plug is configured to transmit radio-frequency signals. These signals need to be shielded. For that reason, twenty ground pins 10 is arranged in four rows having five ground pins 10 as shield elements each. The term "ground pin" is to indicate that the pins in operation can be grounded. The first ground pin in the first row is herein named 10-1-1, the second ground pin in the first row is named 10-1-2. Likewise, the first pin in the second row is named 10-2-1, and so forth. In between the ground pins 10, signal-transmitting pins 12 are arranged as signal elements. The signal-transmitting pins 12 are arranged in between of a group of ground pins 10 each. Consequently, there is one row less for the signal-transmitting pins 12 than with the ground pins, i.e. three rows. There is one signal-transmitting pin 12 less in each row than is the case with the ground pins, i.e. each row comprises four signal-transmitting pins 12. The numbering of the signal-transmitting pins herein corresponds to that of the ground pins. A housing 14 surrounds the overall arrangement and is grounded. The ground pins 10 can be connected to the housing 14 (not shown).

Due to the arrangement of the signal-transmitting pins 12 in the interior of the arrangement of the ground pins, each signal-transmitting pin 12 is surrounded by several ground pins. One can identify the pair of signal-transmitting pins 12-3-1 and 12-3-2. There are two ground pins 10-3-2 and 10-4-2 which commonly shield both of the signals transmitted via the pin 12-3-1 and via the pin 12-3-2. The distance $d_1$ between the signal-transmitting pin 12-3-1 and the ground pin 10-3-2 is smaller than the distance $d_3$ between the two signal-transmitting pins 12-3-1 and 12-3-2. Likewise, the distance $d_2$ between the signal-transmitting pin 12-3-2 and ground pin 10-3-2 is equally smaller than $d_3$. In the presently preferred embodiment, the signal-transmitting pins (e.g., 12-3-1) are arranged in the centre of four ground pins each (such as 10-3-1, 10-3-2, 10-4-1 and 10-4-2), i.e., $d_1=d_2$. The four ground pins are arranged at the edges of a square having a side length of $d_3$. In the embodiment, $d_3$ is equal to 2.95 mm. These four ground pins shield the signal-transmitting pin they surround.

As is shown with respect to signal-transmitting pin 12-2-4 in the second row, one can define a partial circumference extending over an angle $\alpha$ of less than 180° and preferably of less than 120°, in which a ground pin 10-2-5 or 10-3-5 is arranged. This applies with respect to any partial circumference of that size $\alpha$, i.e. the sector can be rotated about the central axis of the pin 12-2-4. The same is true for all of the pins 12. Moreover, for each signal transmitting pin 12 each of these shield pins 10 extends across an angle $\beta$ of less than 20 degrees from the signal-transmitting pin 12.

In the embodiment as a plug, all of the pins 10 and 12 are made out of copper. The isolating body 16 wherein the pins are arranged is made out of PBT Ultradur B4450 having a relative permittivity of 3.9, a dielectric loss tangent of 0.0137, and a bulk conductivity of $1.75*10^{-16}$ Siemens/m. The wave impedance defined for a/any pair of adjacent electrical contact 12 and shield 10 is between 49.5 and 50.5Ω, the closer to 50Ω, the better.

One possible application of the plugs or sockets of the kind shown in FIG. 1 is in the medical field such as in medical imaging, or radiology. One might for example desire to connect several imaging devices including different magnetic resonance coils (MR-colis) to a specific base apparatus. The MR-rails are usually handheld in use. Each MR-coil can then be connected to one and the same base apparatus. The base apparatus is provided with a socket having an arrangement as shown in FIG. 1 with its shields grounded via a housing of the base apparatus, and each of the MR-rails is provided with a plug having the arrangement according to FIG. 1. Since the MR-rails are handheld in use, their shields are grounded via the housing of the base apparatus. The arrangement allows for a quick removal/disconnection of the plug from the socket, and for a quick connection of a different element to the same apparatus. The arrangement enables components to withstand many cycles of disconnecting and re-connecting.

In FIGS. 2*a* to 2*c* another plug according to the invention is shown. Signal-transmitting pins 12 and ground pins 10 are arranged in a fashion similar to that in FIG. 1, but—as can be seen in FIGS. 2*a* and 2*c*—there are only three rows of ground pins 10 separated by two rows of signal-transmitting pins 12. The total number of ground pins 10 is fifteen; the total number of signal-transmitting 12 pins eight. All pins are cylindrical pins of the same length as can be best seen in FIGS. 2*b* and 2*c*. The pins are arranged in parallel and they traverse and are rigidly fixed in an insulating body 16. Each pin protrudes from the insulating body 16 with both of its ends on opposite sides of the insulating body 16.

On one end 20, the pins are connected, typically soldered, to traces of a printed circuit board (not shown), preferably a flexible or semi-flexible printed circuit board. The traces connect all ground pins 10 with each other to ensure that they are on the same potential when the plug is in use. The traces can also connect the ground pins 10 and the signal pins 12 to the leads of a cable connected with the plug, typically by soldering the cable's leads to the traces. The other ends 22 of the pins are arranged so that they can be introduced into corresponding sleeves of a socket corresponding to the plug in order to establish an electrical contact between the pins and the sleeves.

In FIGS. 3*a* to 3*c* a further plug according to the invention is shown. The signal-transmitting pins 12 and ground pins 10 are arranged as the plug of in FIGS. 2*a* and 2*c*, i.e. there are three rows of ground pins 10 separated by two rows of signal-transmitting pins 12. All pins are cylindrical pins as can be best seen in FIGS. 3*b* and 3*c*. The pins are arranged in parallel and they traverse and are rigidly fixed in an insulating body 16. Each pin protrudes from the insulating body 16 with both of its ends on opposite sides of the insulating body 16.

As in the plug of FIGS. 2*a* to 2*c*, the pins on one end 20 are connected, typically soldered, to traces of a printed circuit board (not shown), preferably a flexible or semi-flexible printed circuit board. The traces connect all ground pins 10 with each other to ensure that they are on the same potential when the plug is in use. The traces can also connect the ground pins 10 and the signal pins 12 to the leads of a cable connected with the plug, typically by soldering the cable's leads to the traces. The other ends of the pins are arranged so that they can be introduces into corresponding sleeves of a socket corresponding to the plug. Yet, unlike in the plug of FIGS. 2*a* to 2*c*, the pins in the plug of FIGS. 3*a* to 3*c* are of different lengths: The ground pins of the two outer rows 24 are shorter than the other pins 22. The longer pins 22 have a length suitable to establish contact between the pins and the sleeves of the socket. In contrast, the shorter pins 24 do not need to contact the corresponding sleeves 24' but are grounded by virtue of being connected to the other, longer ground pins via the traces of the circuit board.

In FIGS. 4*a* to 4*c* a socket according to the invention is shown, which socket can mate with the plug of FIGS. 3*a* to 3*c*. Signal-transmitting sleeves 12' as signal elements and ground sleeves 10' as shield elements are arranged in a fashion corresponding to that in FIGS. 3*a* and 3*c*, i.e. there are three rows of ground sleeves 10' separated by two rows of signal-transmitting sleeves 12'. As can be best seen in FIGS. 4*b* and 4*c*, all sleeves are cylindrical, comprising an upper open hollow portion and a lower solid portion 26. The sleeves are arranged in parallel and they traverse and are rigidly fixed in an insulating body 16'. Each sleeve protrudes from one side of the insulating body 16' with its solid portion end 20'; on the other side of the insulating body 16', the hollow portion of the sleeve is accessible through a hole in the insulating body 16'.

The solid portion ends 20' of the sleeves of the socket are connected, typically soldered, to traces of a printed circuit board (not shown), preferably a flexible or semi-flexible printed circuit board. The traces connect all ground sleeves 10' with each other to ensure that they are on the same potential when the socket is in use. The traces can also connect the ground sleeves 10' and the signal sleeves 12' to the leads of a cable connected with the socket, typically by soldering the cable's leads to the traces. The other ends of the sleeves are arranged so that pins of a plug corresponding to the socket can be introduces into their corresponding sleeves of a socket.

As can be seen in FIG. 4*b*, all sleeves except for the ground sleeves of the two outer rows 24' each are provided with one or more slots, typically two or four equidistant slots, which extend in the sleeve's longitudinal direction from the open end of the sleeve along approximately two thirds of the sleeve's hollow portions. Thereby, tongues 28 are formed that can resiliently contact the corresponding pin when it is introduced into the sleeve in order to establish an electrical contact. In their relaxed state, the tongues 28 are slightly bent inwards as shown in FIG. 4*b*. In contrast, the ground sleeves of the two outer rows 24' do not have such slots and therefore lack resilient tongues. This is because they do not need to contact their corresponding ground pins 24, but are grounded by virtue of being connected to the other, slotted ground pins via the traces of the circuit board.

Generally, with the present invention, connectors can be provided which are able to withstand more than 5,000, preferably more than 20,000, preferably more than 50,000, and most preferably more than 100,000 cycles of connecting and disconnecting.

What is claimed is:

1. An electrical connector comprising a plug and a socket, the plug being configured for mating with the socket, the plug comprising:

a first field of electrically conducting signal elements electrically insulated from each other; and a first field of electrically conducting shield elements, the shield elements of the first field of electrically conducting shield elements being electrically interconnected with each other, the socket comprising:

a second field of electrically conducting signal elements electrically insulated from each other; and a second field of electrically conducting shield elements, the shield elements of the second field of electrically conducting shield elements being electrically interconnected with each other, wherein:

for each signal element of the first field of electrically conducting signal elements, in any partial circumference extending over an angle of more than 160 degrees from the signal element of the first field of electrically conducting signal elements, at least one shield element of the first field of electrically conducting shield elements is arranged such that the at least one shield element of the first field of electrically conducting shield elements is closer to the signal element of the first field of electrically conducting signal elements than any other signal element of the first field of electrically conducting signal elements, each shield element of the first field of electrically conducting shield elements extending across an angle of less than 160 degrees from the signal element of the first field of electrically conducting signal elements, wherein:

for each signal element of the second field of electrically conducting signal elements, in any partial circumference extending over an angle of more than 160 degrees from the signal element of the second field of electrically conducting signal elements, at least one shield element of the second field of electrically conducting shield elements is arranged such that the at least one shield element of the second field of electrically conducting shield elements is closer to the signal element of the second field of electrically conducting signal elements than any other signal element of the second field of electrically conducting signal elements, each shield element of the second field of electrically conducting shield elements extending across an angle of less than 160 degrees from the signal element of the second field of electrically conducting signal elements, wherein:

at least one shield element of the first field of electrically conducting shield elements is configured for mating with the corresponding shield element of the second field of electrically conducting shield elements when the plug is mated with the socket, and wherein:

at least one shield element of the first field of electrically conducting shield elements is configured for not electrically contacting a corresponding shield element of the second field of electrically conducting shield elements when the respective shield element of the first field of electrically conducting shield elements is mated with the corresponding shield element of the second field of electrically conducting shield elements.

2. The electrical connector according to claim 1, wherein an extension of the shield elements of the first field or the second field of electrically conducting shield elements in a mating direction of the electrical connector is at least 25% of extensions of all corresponding signal elements of the first field or the second field of electrically conducting signal elements in the mating direction.

3. The electrical connector according to claim 1, wherein a number of shield elements of the first field or the second field of electrically conducting shield elements is shared between the signal elements, of the first field or the second field of electrically conducting signal elements, with the number of shield elements of the first field or the second field of electrically conducting shield elements being less than 3 times the number of signal elements of the first field or the second field of electrically conducting signal elements.

4. The electrical connector according to claim 1, wherein the plug comprises rows of shield elements of the first field of electrically conducting shield elements alternating with at least one row of signal elements of the first field of electrically conducting signal elements, and wherein the socket comprises rows of shield elements of the second field of electrically conducting shield elements alternating with at least one row of signal element of the second field of electrically conducting signal elements.

5. The electrical connector according to claim 1, wherein for each respective signal element of the first field or the second field of electrically conducting signal elements, there are at least 3 shield elements of the first field or the second field of electrically conducting shield elements closer to the respective signal element of the first field or the second field of electrically conducting signal elements, than any other signal element of the first field or the second field of electrically conducting signal elements.

6. The electrical connector according to claim 1, wherein for each respective signal element of the first field or the second field of electrically conducting signal elements, in any partial circumference extending over an angle of more than 120 degrees from the respective signal element, at least one shield elements is arranged that is closer to this signal element of the first field or the second field of electrically conducting signal elements, than any other signal element of the first field or the second field of electrically conducting signal elements.

7. The electrical connector according to claim 1, wherein for each respective signal element of the first field or the second field of electrically conducting signal elements, each shield element of the first field or the second field of electrically conducting shield elements that is closer to the respective signal element than any other signal element of the first field or the second field of electrically conducting signal elements extends across an angle of less than 100 degrees from the respective signal element.

8. The electrical connector according to claim 1, wherein an amount of conducting elements of the plug that are comprised in the first field of electrically conducting signal elements or the first field of electrically conducting shield elements is at least 50% of the amount of all conducting elements of the plug, and wherein an amount of conducting elements of the socket that are comprised in the second field of electrically conducting signal elements or the second field of electrically conducting shield elements is at least 50% of the amount of all conducting elements of the socket.

9. The electrical connector according to claim 1, wherein at least one signal element of the first field or the second field of electrically conducting signal elements and the shield element or shield elements of the first or the second field of electrically conducting shield elements corresponding to the at least one signal element of the first field or the second field of electrically conducting signal elements are designed and arranged in such a manner that wave impedance of the at least one signal element of the first field or the second field of electrically conducting signal elements and the corresponding shield element or shield elements of the first or the second field of electrically conducting shield elements is between 25Ω and 150Ω.

10. The electrical connector according to claim 1, wherein the signal elements of the first field or the second field of electrically conducting signal elements and/or the shield elements of the first or the second field of electrically conducting shield elements are cylindrical pins.

* * * * *